US005393234A

United States Patent [19]

Yamada et al.

[11] Patent Number: 5,393,234

[45] Date of Patent: Feb. 28, 1995

[54] EDGE CONNECTORS AND CONTACTS USED THEREIN

[75] Inventors: Shoji Yamada, Machida; Tomoo Yamada, Yokohama, both of Japan

[73] Assignee: The Whitaker Corporation, Wilmington, Del.

[21] Appl. No.: 97,701

[22] Filed: Jul. 27, 1993

[30] Foreign Application Priority Data

Sep. 28, 1992 [JP] Japan ..... 4-073007

[51] Int. Cl.[6] ..... H01R 13/648

[52] U.S. Cl. ..... 439/62; 439/64; 439/637

[58] Field of Search ..... 439/62, 377, 629–637, 439/328, 329, 64, 326

[56] References Cited

U.S. PATENT DOCUMENTS

| | | | |
|---|---|---|---|
| 3,216,580 | 11/1965 | Fricker, Jr. | 439/328 |
| 3,932,016 | 1/1976 | Ammenheuser | 439/377 |
| 4,850,892 | 7/1989 | Clayton et al. | 439/326 |
| 5,016,142 | 5/1991 | White | 439/64 X |
| 5,035,632 | 7/1991 | Rudoy et al. | 439/62 X |
| 5,154,631 | 10/1992 | Belanger, Jr. | 439/377 |
| 5,163,854 | 11/1992 | Licht et al. | 439/637 |
| 5,254,017 | 10/1993 | Tondreault et al. | 439/637 |
| 5,259,768 | 11/1993 | Brunker et al. | 439/637 |
| 5,259,793 | 11/1993 | Yamada et al. | 439/637 |

FOREIGN PATENT DOCUMENTS

| | | | |
|---|---|---|---|
| 1082958 | 6/1960 | Germany | 439/64 |
| 61-103883 | 2/1986 | Japan . | |
| 1-84166 | 5/1989 | Japan . | |

*Primary Examiner*—William Briggs
*Attorney, Agent, or Firm*—Adrian J. LaRue

[57] ABSTRACT

The purpose of this invention is to offer an edge connector which requires less space for insertion of a card and has a reduced stress in the housing due to dissipation of mechanical stress. Accordingly, the invention comprises a C-shaped connector 1 having a housing that has a reception groove 8 and guiding grooves 10, 10' for a memory card 100. In the upper walls forming the guiding grooves 10, 10' protrusions 12, 14 are formed. These protrusions match indentations 108, 110 in the memory card. The memory card 100 can be inserted into the guiding grooves 10, 10; only when the protrusions 12, 14 and indentations 108, 110 are properly aligned. After that the memory card is moved along the grooves 10, 10' toward the contacts 70, 70' arranged in the main body 4 of the housing. Contacting arms 78, 78' of adjacent contacts 70, 70' make connection alternately with the conducting pads 106 on the upper surface 111 and lower surface 112 of the memory card 100, thus preventing the concentration of mechanical stress in the housing 2 retaining contacts 70, 70' therein and to the solder connections of the contacts to a circuit board 18.

8 Claims, 3 Drawing Sheets

EDGE CONNECTORS AND CONTACTS USED THEREIN

FIELD OF THE INVENTION

This invention relates to edge connectors designed for connection to conducting pads made on memory cards, IC cards, and the like. The invention also relates to the contacts used in such edge connectors.

BACKGROUND OF THE INVENTION

Edge connectors are usually attached to printed boards and are used for connection of cards used for retrieving or storing computer data files. For example, in Japanese Publication No. (1989) 84166, cards are inserted parallel to the board by means of an edge connector attached to the edge of the board. In such a configuration, no additional space is required around the board periphery for insertion of the cards, and the edge connectors are extended from the side of the board toward its center. However, its shortcoming consists in that the inserted card can interfere with other electronic or electric devices mounted on the board, or that it will result in the necessity to withhold mounting certain electronic or electric devices in order to reserve space for the cards.

In addition, in the housings of the edge connectors there are contacts to form connection with contacts or the conductive pads of the card. The shape of the contacts known in the art is a cantilever, as disclosed in Japanese Publication No. (1986)-103388, or in Japanese Publication No. (1992)-83224. Upon forming connection with their counterparts, contacts having such a configuration are bent in one direction and the reaction to this bending strain is applied to the location where the contacts are fixed to the housing. This may lead to damage to the housing, or cracking of the soldered connections of the contacts with the printed circuit board.

SUMMARY OF THE INVENTION

The purpose of this invention is to offer an edge connector which does not take a lot of space for the insertion of cards and can be mounted at any location.

Another purpose of this invention consists in offering contacts for edge connectors that can prevent concentration of reaction in one place, thus preventing damage to the housing and cracking of soldered connections.

Edge connectors according to this invention represent an edge connector having a more or less C-shaped insulating housing whose main body contains a number of contacts for making connection with conductive pads or contacts of a memory card or similar devices, and guiding grooves located in arms formed on both sides of the main body to accommodate sides of the card wherein indentations are provided in the upper portion of walls of the arms which match by the shape and by the location profiles provided in the sides of the card, and whereby the card is placed within the arm grooves from the top of the edge connector by aligning the arm indentations and card profiles, and then sliding the card along the grooves in the direction of the contacts to complete electrical connection therewith. The contacts according to this invention are mounted along the entire length of a reception groove of an edge connector insulating housing with the reception groove intended for receiving the front edge of a memory card or similar devices and guiding grooves intended for receiving both side edges of the card, and the contacts provided along the length of the reception groove are distributed alternately, with one contact having a cantilevered contacting arm making connection with the conducting pad on one side of the card and a mounting leg secured in the insulating housing, and the other contact next to the previous one having its cantilevered contacting arm making contact with the conducting pad on the other side of the card and that the reaction to the mechanical strain applied to the insulating housing and the connections of the contacts to the circuit board due to the insertion of the card is dispersed.

BRIEF DESCRIPTION OF THE DRAWINGS

The invention will now be described by way of example with reference to the accompanying drawings in which.

DETAILED DESCRIPTION OF THE DRAWING

Figure 1:
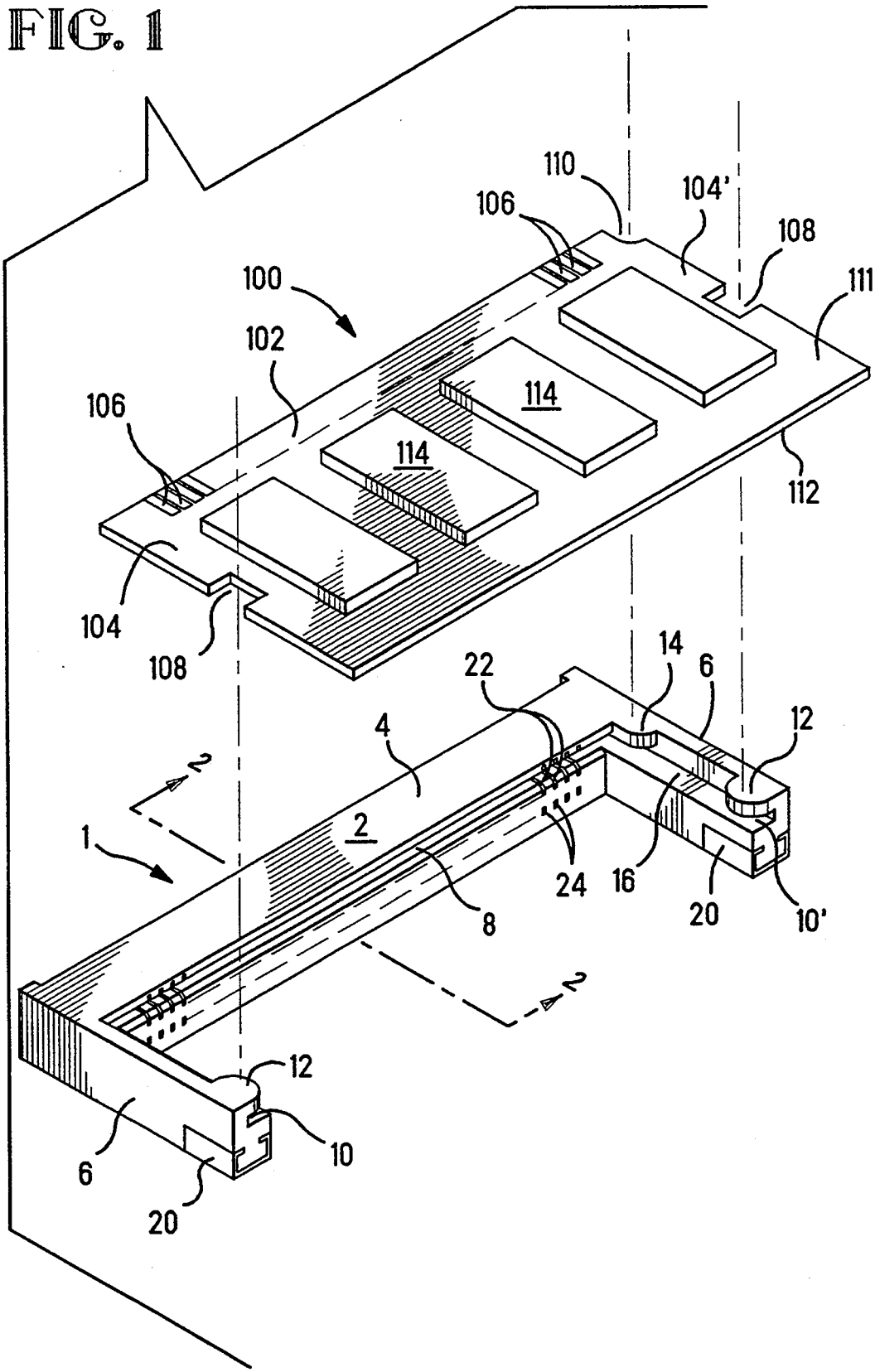
FIG. 1 is an exploded perspective view of an edge connector according to this invention and a memory card to be inserted therein.

FIG. 1 represents an edge connector 1 according to this invention and a card 100. Edge connector 1 has a C-shaped insulating housing 2 and contacts 70. At both ends of the housing 2, there are arms 6 which are made as a single unit with the main body 4. In the inside surfaces of main body 4 and arms 6, there are a card-reception groove 8 and card-guiding grooves 10 and 10' made to accommodate card 100. Front edge 102 of card 100 is inserted in the reception groove 8 of the main body 4, and side edges 104, 104' of card 100 are inserted in the guiding grooves 10, 10' of arms 6. Contacts 70, 70' (FIGS. 2 and 3) are arranged along the length of the reception groove 8. In FIG. 1, slots 22 for contacting arms 78, 78' of contacts 70, 70' and slots 24 for mounting bases 74, 74' of contacts 70, 70' are located in housing 2. Contacts 70, 70' make electrical connection with the conducting pads 106 on upper surface 111 and lower surface 112 of the card 100. The central portion of the upper edge of the guiding grooves 10, 10' is cut out, and the remaining portions form protrusions or projections 12 and 14.

In the side edges 104, 104' of card 100, recesses 108, 110 are made. Recess 108 corresponds in shape and location to protrusion 12, and recess 110 corresponds in shape and location to protrusion 14. When, during insertion of card 100 in the edge connector 1, recesses 108, 110 of the card 100 become coincident with protrusions 12, 14 of the edge connector 1, as card 100 is moved downward. Recesses 108, 110 pass protrusions 12, 14 and the side edges 104, 104' are disposed in grooves 10, 10'. At this time, the lower surface 112 of the side edges 104, 104' of the card 100 engages the bottom surface of the guiding grooves 10, 10' thus preventing its further downward movement. Connection of card 100 and the edge connector 1 is completed by sliding the card further along the guiding grooves 10, 10' toward the reception groove 8 until the conducting pads 106 make connection with contacts 70, 70'. The conducting pads 106 are on the upper surface 111 and lower surface 112 of card 100.

In this embodiment, card 100 carries IC packages 114, but from its appearance it is not always clear which way the card should be inserted into the connector. The role of protrusion 14 and recess 110 is to prevent wrong connection. That is, if somebody tries to insert card 100 upside down, its side edge 104 will engage protrusion 14 and the card 100 will be prevented from being positioned in guiding grooves 10, 10'.

Edge connector 1 is fixed to a printed circuit board 18 (FIG. 2) by a known means, for example, by bolts (not shown). In addition, in this embodiment, C-shaped metal members 20 are fixed at the front end of arms 6 (FIG. 1). These members 20 can be attached to the printed circuit board 18 by means of surface mounting technique (SMT).

Figure 2:
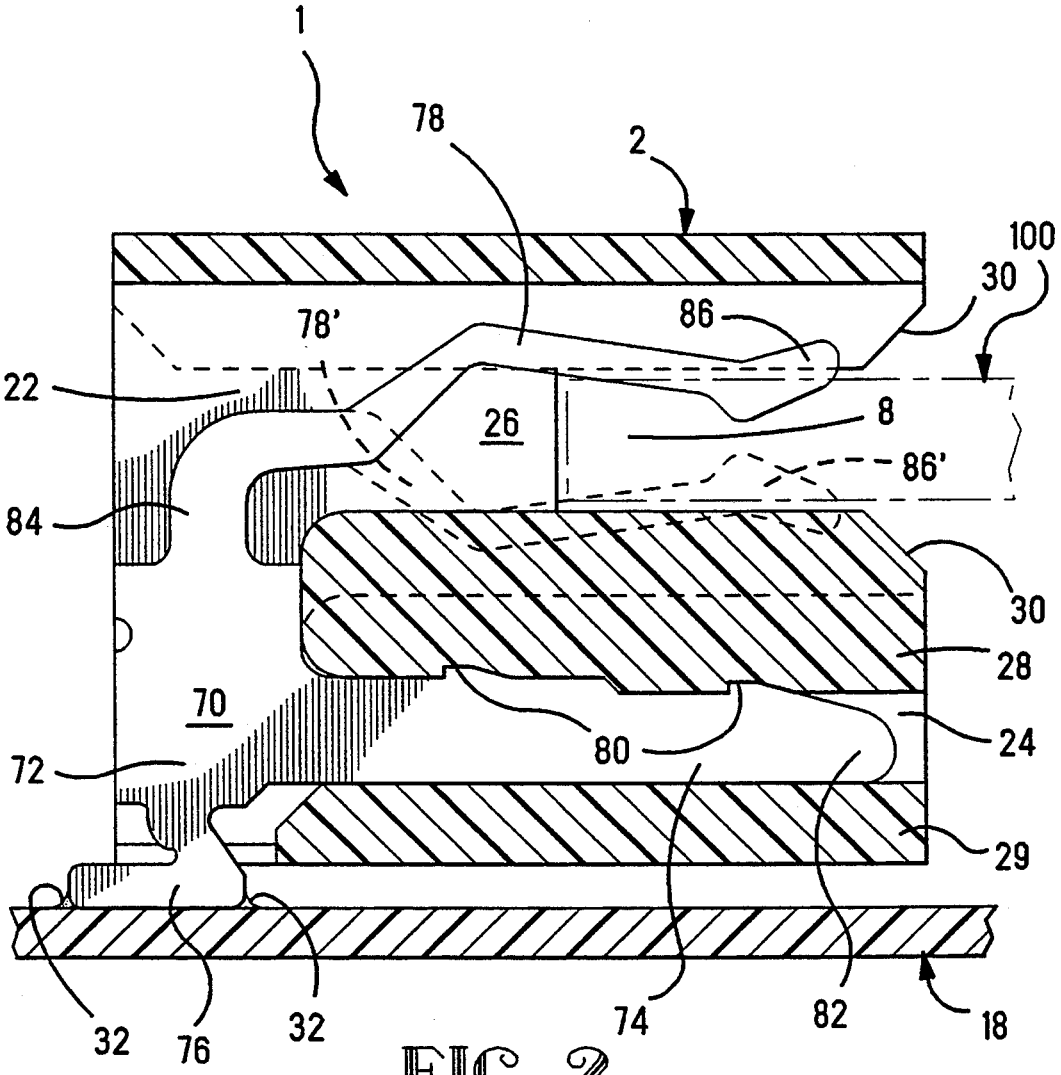
FIG. 2 is a cross-sectional view taken along the line 2—2 of the edge connector shown in FIG. 1.

FIG. 2 is a cross-section of the edge connector 1 shown in FIG. 1. Housing 2 has slots 22 for contacting arms 78, 78' and slots 24 for mounting bases 74, 74'. Slots 22 for contacting arms 78, 78' are connected with the reception groove 8. Slots 22 for contacting arms and slots 24 for mounting bases are separated by partitions 26. Slots 22 for contacting arms and slots 24 for mounting bases are separated by a central partition 28 which is an integral part of the housing 2, but their rear portions are connected together. The front edge of the reception groove 8 has a chamfer 30 to facilitate insertion of the front edge 102 of the card 100 thereinto.

Contacts 70, 70' are made by stamping from a metal strip and include main portions 72, 72' in the shape of a carpenter's square whose forward extension form the mounting bases 74, 74'. At the lower end of the main portions 72, 72' contact portions 76, 76' are provided for connection of the contacts to the surface of the printed circuit board 18, and at the top of the main portions, 72, 72' there are contacting arms 78, 78' cantilevered therefrom and extending forward whose purpose is to make connection with the conducting pads 106 located on top and bottom surfaces of card 100. At the upper edge of the mounting base 74, 74' spaced protrusions 80, 80' are located, and the free end 82, 82' of the mounting base is rounded. Contacts 70, 70' differ from each other only by the configuration of their contacting arms 78, 78'; namely, contacting arms 78 of contacts 70 make connection with the conducting pads 106 on the top surface of card 100 and extend from curved portions 84 first slightly upward then obliquely slightly downward, and end with contact members 86 which engage the conducting pads 106. Contacting arms 78' of the contacts 70' are intended to make connection with the conducting pads 106 (not shown in the Figure) on the lower surface of the card 100. They extend downward from the curved portions 84' and their shape is symmetrically opposed to the shape of the contacting arms 78 ending with contact members 86'.

Contacts 70, 70' are mounted into the housing 2 by alternately inserting their mounting bases 74, 74' into corresponding slots 24 from the back side of the housing 2 and their contacting arms 78, 78' extend along the reception groove 8. Protrusions 80, 80' become engaged with the internal wall of the mounting slots 24 and secure the mounting bases 74, 74' by wedging it between the central partition 28 and the bottom 29. Contacting arms 78 are placed in the upper section of the reception groove 8 and contacting arms 78' are placed in the lower section of the reception groove 8. When card 100 is inserted in the reception groove 8, contact members 86, 86' of contacting arms 78, 78' make connection respectively with conducting pads 106 on the upper and lower surfaces of card 100.

At this time, the moment of torsion of contacts 70, 70' resulting from the bending of the contacting arms 78, 78' is transmitted to the mounting bases 74, 74'; but since the two types of contacts 70, 70' arranged alternately are involved, the force of the mounting bases 74, 74' acting on the housing 2 is dispersed between the central partition 28 and the bottom 29, thus eliminating concentration of the reaction stress applied to the housing 2 and reducing the possibility of its distortion. The stress applied to contact portions 76, 76' is also reduced making it more difficult for cracks to appear in solder connections 32 to the printed circuit board 18.

Figure 3B:
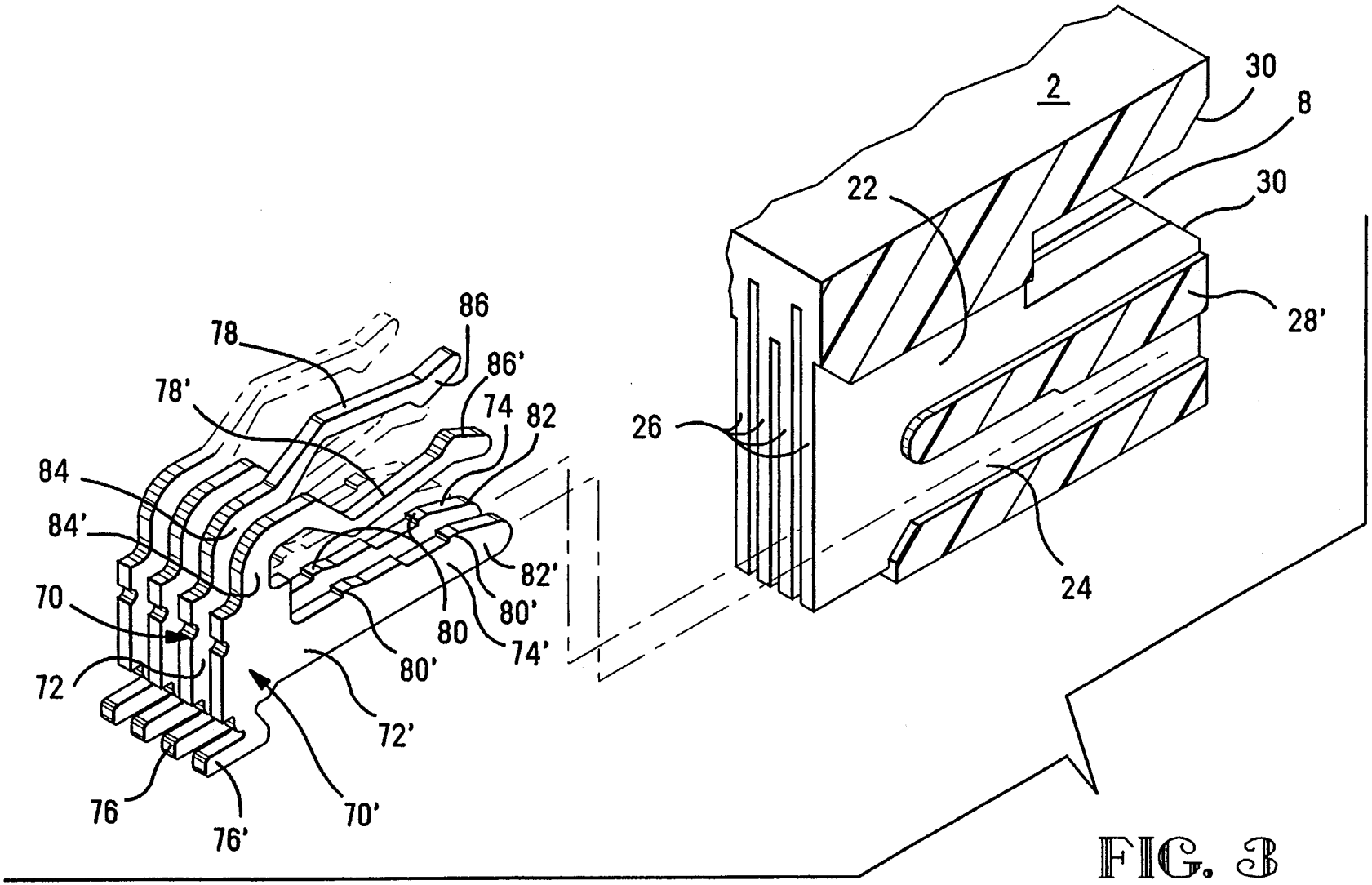
FIG. 3 is an exploded perspective view of contacts and a part of the housing.

FIG. 3 is a perspective view showing contacts 70, 70' separately from the housing 2. It clearly shows alternating positions of the two types of contacts. In FIG. 3, the central partition 28' is thinner than partition 28 in FIG. 2 to give more freedom of movement to the contacting arms 78'. However, the moment of torsion produced by the mounting bases 74, 74' does not affect the central partition 28'.

The above description concerns a preferred embodiment, however, the shape of the arms, shape and position of the protrusions of the edge connector can be of any configuration and are not limited to this embodiment only. The shape of the contacts is not limited to the configuration described in this embodiment, and also can be changed without changing the concept of this invention. The main portions of the contact can be provided with SMT contact portions so that the connector can be mounted vertically onto the circuit board.

Edge connectors according to this invention have indentations in the upper walls of the both arms matching indentations made in the card side edges. Therefore, the card can be put into the guiding grooves only when card indentations match the indentations made in the arms, after which the card can be slid towards the contacts. As a result, the card can be inserted without interference with other electronic components. These edge connectors require very little space for insertion of cards and, therefore, can be mounted practically in any location. In addition, by varying the shape or position of the indentations in the arms, it is possible to eliminate insertion of wrong components in wrong places. Another positive feature of these connectors is that open space remaining above the edge connector makes it possible to easily identify the card. Edge connectors can be made with grooves of a simple configuration.

The contacts used in the edge connectors according to this invention have a mounting base, a cantilevered contacting arm and a contact portion. The contacting arms are arranged in such a way that one of two adjacent arms makes contact with the upper surface of the card and the other one with the lower surface. Therefore, the mechanical reaction in the housing produced by the mounting bases of the contacts is dispersed thereby reducing the risk of damage to the housing and preventing the solder connections of the contact portions from cracking. All this results in a longer service life of the edge connectors and a higher reliability of the electrical connections.

We claim:

1. An electrical connector comprising an insulative housing having a reception groove for receiving an edge of a circuit card and electrical contacts secured in slots of the housing including contact sections for electrical connection with conducting pads along the circuit card edge, contact portions for electrical connection to a circuit board, and mounting bases of the contacts securing the contacts in the housing, characterized in that the electrical contacts include a main portion, a curved portion of smaller cross-sectional extent than said main portion and extending outwardly from said main portion including a first section normal to said reception groove and a second section extending toward said reception groove, alternate ones of he electrical contacts include a contact arm extending forwardly from said curved portion including upwardly and downwardly oblique sections, and a contact member at an outer end of said contact arm for electrical connection with a conducting pad on one surface of the circuit card, other alternating ones of the electrical contacts include another contact arm extending forwardly from said curved portion including downwardly and upwardly oblique sections, and another contact member at another end of said other contact arm for electrical connection with a conducting pad on the other surface of the circuit card, and said mounting bases being an extension of said main portion perpendicular to said first section and extending parallel to said reception groove.

2. An electrical connector as claimed in claim 1, characterized in that said housing has a main body containing said reception groove, and arms having card receiving grooves therein in alignment with said reception groove so that the circuit card can be moved along the card-receiving grooves into said reception groove and into electrical engagement with the contact sections, and said arms have projections, and the circuit card has recesses that mate with said projections when the card is inserted into the card receiving grooves in a direction normal to the card receiving grooves.

3. An electrical connector as claimed in claim 2, characterized in that said arm includes a protrusion and the circuit card has a recess aligned with said protrusion to allow insertion of the card in only one direction.

4. An electrical connector as in claim 1, wherein said bases have barbs for securing said contact in said housing.

5. An electrical connector as in claim 4, wherein said mounting bases are secured into slots which extend completely through the housing.

6. An electrical connector as in claim 1, wherein said contact portions are surface mount portions.

7. An electrical connector as in claim 1, wherein said main portion is in the shape of a carpenter's square.

8. An electrical connector as claimed in claim 2, characterized in that said arms have metal members affixed thereto for attaching the connector to a circuit board.

* * * * *